United States Patent [19]

Mori

[11] Patent Number: 5,069,097

[45] Date of Patent: Dec. 3, 1991

[54] PAPER-CUTTING MACHINE AND METHOD OF CUTTING PAPER

[75] Inventor: Chuzo Mori, Katsushika, Japan

[73] Assignee: Carl Manufacturing Co., Ltd., Katsushika, Japan

[21] Appl. No.: 307,966

[22] Filed: Feb. 9, 1989

[30] Foreign Application Priority Data

Feb. 29, 1988 [JP] Japan ..... 63-26776[U]

[51] Int. Cl.[5] ..... B26D 1/18

[52] U.S. Cl. ..... 83/56; 83/455; 83/458; 83/471.2; 83/588; 83/614

[58] Field of Search ..... 83/56, 455, 456, 458, 83/459, 462, 485, 588, 614, 698, 471.2; 269/256, 317

[56] References Cited

U.S. PATENT DOCUMENTS

| | | | |
|---|---|---|---|
| 237,280 | 2/1881 | Hoopes et al. | 83/455 |
| 614,407 | 11/1898 | Morrison et al. | 83/455 |
| 791,793 | 6/1905 | Johnson | 83/485 |
| 1,306,261 | 6/1919 | Klein | 83/455 |
| 1,732,148 | 10/1929 | Barrett | 83/614 |
| 2,013,893 | 9/1935 | Matthews | 83/455 |
| 2,109,889 | 3/1938 | Morin | 83/485 |
| 2,531,149 | 11/1950 | Melchor | 83/455 |
| 4,715,737 | 11/1979 | Foss | 269/317 |

*Primary Examiner*—Hien H. Phan
*Attorney, Agent, or Firm*—Oliff & Berridge

[57] ABSTRACT

A paper-cutting machine has a board which is provided at one end thereof with a rail support for supporting a rail. One end of the rail is pivotally supported by the rail support through a pin. Thus, the other end of the rail is movable up and down about the pin. A slider is movably provided on the rail. A rotatable cutter blade is attached to the slider. A paper holder is resiliently supported on the reverse side of the rail through a spring. A hook is attached to the distal end of the rail. The distal end of the rail is fixedly fitted to a guide member provided on the board. The rail support is provided with guide pins for pressing both side surfaces, respectively, of the rail by means of resilient force from respective springs. The slider is mainly comprised of a cutter blade-side slider body, a slider body and a cutter blade holder. The cutter blade holder is equipped with the cutter blade which is rotatably attached to a slide portion of the cutter blade holder.

3 Claims, 5 Drawing Sheets

PAPER-CUTTING MACHINE AND METHOD OF CUTTING PAPER

BACKGROUND OF THE INVENTION

1. Field of the Invention

The present invention relates to a paper-cutting machine which is used as a business machine and a method of cutting paper with this paper-cutting machine.

2. Description of the Prior Art

Conventional cutters have generally been arranged such that a cutting blade which is pivotally supported at one end thereof is pressed against a stack of sheets of paper by gripping a grip attached to the other end of the cutting blade, thereby force-cutting the sheets of paper, or a circular cutting blade is drawn flush with an edge of a board to thereby cut the paper.

These conventional cutters are designed to cut paper by means of shearing force by making use of the principle of scissors.

When a stack of sheets of paper is cut using the shearing force based on the principle of scissors, the cut edges of the sheets are likely to be offset from each other and therefore the number of sheets of paper which can be stacked is limited.

The above-described conventional cutters also suffer from the problem that, when a staple or the like is accidently cut, the cutting blade may be nicked or become dull and, in such a case, the cutting blade, which is expensive, must be replaced with an new one.

SUMMARY OF THE INVENTION

The paper-cutting machine according to the present invention has a board. A support for supporting a rail is secured to one end of the board. One end of the rail is pivotally supported by the support through a pin. Thus, the rail is pivotally movable up and down about the pin.

On the rail is fitted a slider which is movable along the rail. The slider is provided with a circular cutting blade (hereinafter referred to as simply "cutter blade") for cutting paper.

On the reverse side of the rail is mounted a paper holder which is resiliently supported through a spring. A hook is attached to the other end of the rail, that is, the end of the rail on the side thereof which is remote from the support pin.

A guide member is secured to the other end of the board, that is, the end of the board on the side thereof which is remote from the support, so that the end portion of the rail which is provided with the hook is fitted to the guide member.

The rail support is provided with two guide pins for pressing both side surfaces, respectively, of the rail by means of resilient force from respective springs. The guide pins function as means for preventing transverse oscillation of the rail when pivotally moved up and down about the pin.

The slider that is movably fitted on the rail is mainly comprised of a cutter blade-side slider body, a slider body and a cutter blade holder.

The cutter blade holder is mainly comprised of a cutter blade holding plate, a slide portion, a fastening plate provided with a slider fastening screw, and a circular cutter blade.

The cutter blade is rotatably attached to the slide portion in such a manner that a polygonal column which is provided on the holding plate is fitted into a polygonal bore provided in the cutter blade.

The paper-cutting machine arranged as described above is used as follows.

The rail is pivotally raised about the pin. Paper which is to be cut is placed on the board. Then, the rail is lowered. In consequence, the paper is strongly clamped between the board and the paper holder. The distal end of the rail is guided by the guide member and secured by means of the hook.

The paper is cut by moving the slider along the rail. During this cutting process, the cutter blade cuts into the paper while rotating.

It is a first object of the present invention to prevent the cut surfaces of a stack of sheets of paper which are cut simultaneously from being offset from each other.

It is a second object of the present invention to minimize the possibility of the cutter blade being broken or nicked to thereby extend the lifetime of the cutter blade.

It is a third object of the present invention to facilitate replacement of cutter blades to thereby enhance the practicability of the paper-cutting machine as being a business machine.

It is a fourth object of the present invention to enable paper which is to be cut to be clamped in a stable state to thereby cut it into desired dimensions with high accuracy.

According to the paper-cutting machine of the present invention, paper which is to be cut is reliably fixed between the paper holder and the board.

The reason why the paper is reliably fixed between the paper holder and the board is that the paper holder is resiliently supported and the rail is firmly fixed at both ends thereof by the support and the hook.

With the paper reliably fixed and the rail firmly fixed at both ends thereof, the slider is moved along the rail. In consequence, the cutter blade cuts into the paper while rotating to thereby cut it. Accordingly, there is no fear that the cut surfaces of a stack of sheets of paper which are cut simultaneously may be offset from each other.

The rail is disposed parallel with the ruled lines on the board by virtue of the guide pins provided on the support and the guide member provided on the board, so that it is possible to cut paper into desired dimensions with high accuracy.

Since the slider comprises three separate constituent members, that is, the cutter blade holder, the cutter blade-side slider body and the slider body, the slider is readily fitted on the cutter rail. The cutter blade can be replaced with a new one easily by detaching the cutter blade holding plate. Since the cutter blade holder is movable up and down through the resilient force from a spring and the cutter blade is rotatable, the force with which the cutter blade is pressed against the paper is limited by the resilient force from the spring. Accordingly, when encountering a foreign matter (a staple or the like), the cutter blade rides over it while rotating in such a manner that the cutter blade vertically moves away from the foreign matter against the resilient force from the spring. In this way, the cutter blade is prevented from being subjected to any extraordinary force. Thus, it is possible to prevent the cutter blade from being nicked or broken.

DESCRIPTION OF THE PREFERRED EMBODIMENT

One embodiment of the present invention will be described hereinunder in detail with reference to the accompanying drawings.

Figure 1:
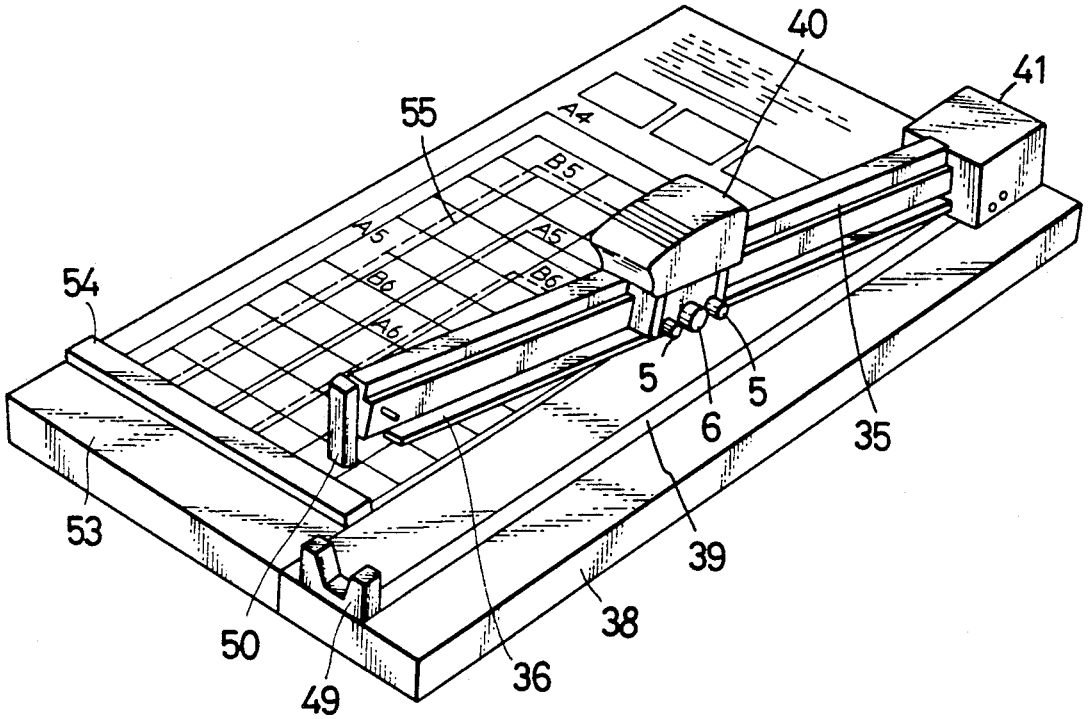
FIG. 1 is a perspective view of one embodiment of the present invention.

Referring to FIG. 1, a rail support 41 is secured to one end of a board 38. A rail 35 is supported by this rail support 41.

Figure 2:
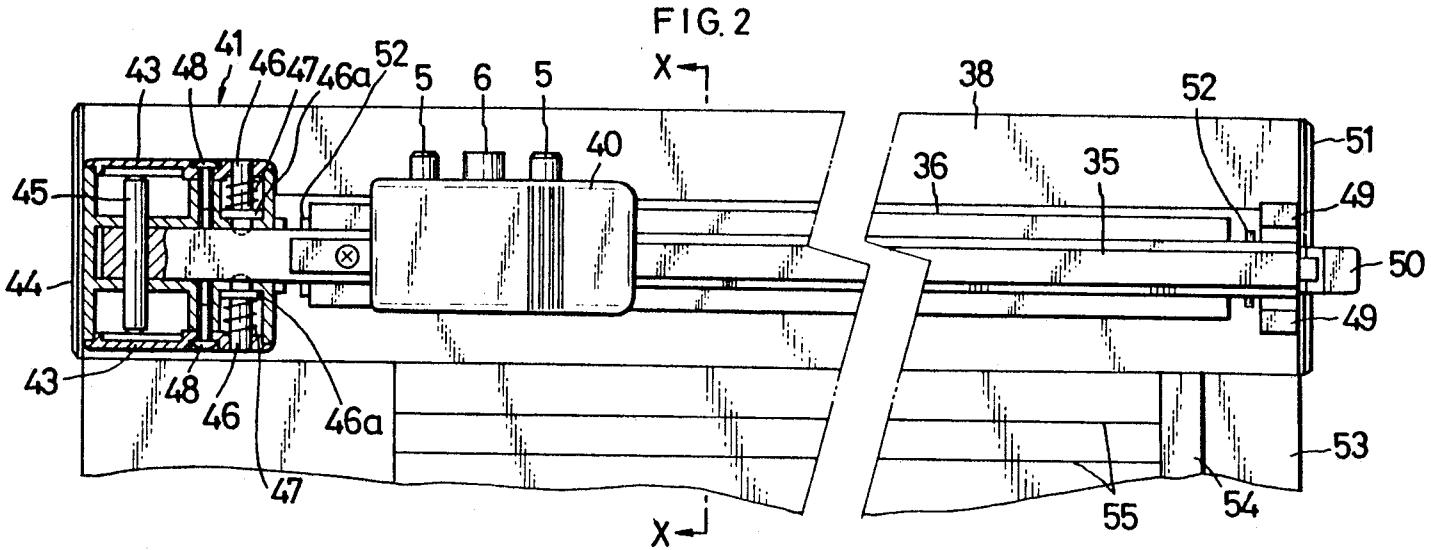
FIG. 2 is a plan view of the rail and members associated therewith, which shows the rail support in a horizontal sectional view.
Figure 3:
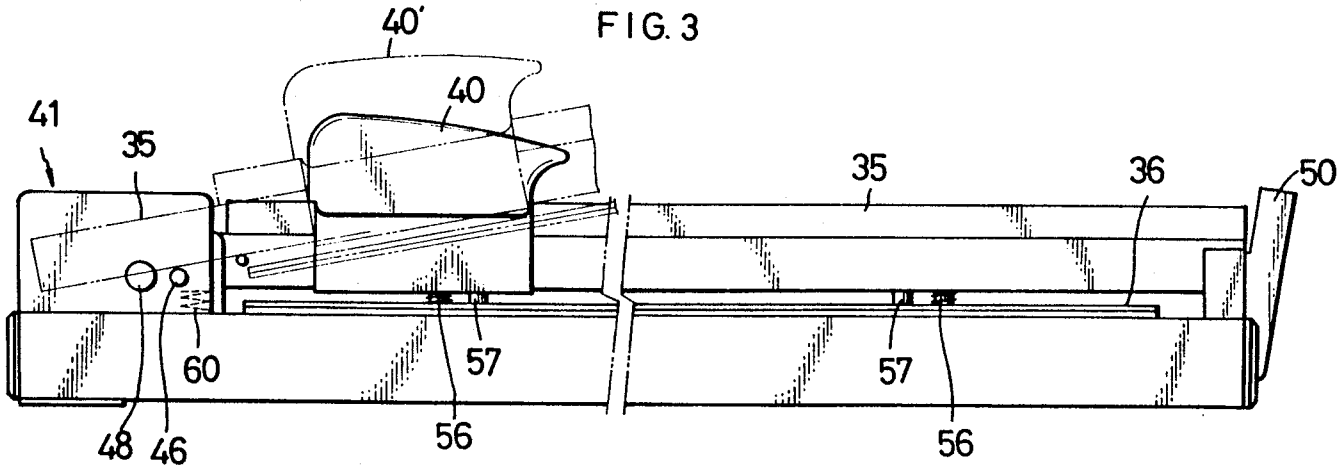
FIG. 3 is a side view of the arrangement shown in FIG. 2.

The rail supporting structure is designed such that the rail 35 is fitted in a gap provided in a support body 44 and supported through a pin 45, as shown in FIGS. 2 and 3. The rail support 41 is provided with guide pins 46 which face both side surfaces, respectively, of the rail 35. The guide pins 46 are mounted by securing side plates 43 to the support body 44 by means of screws 48 with springs 47 loaded on the respective guide pins 46. The springs 47 are compressed between the flanges 46*a* of the guide pins 46 and the side plates 43, respectively. Thus, the guide pins 46 are constantly biased toward the rail 35 by means of resilient forces from the springs 47.

The guide pins 46 project underneath the rail 35 when pushed up to the position denoted by the reference numeral 35' by the action of a spring 60, as shown in FIG. 3. The amount by which the guide pins 46 project is limited by the flanges 46*a*. When the rail 35 is pushed down, the distal ends (spherical) of the guide pins 46 slide on the side surfaces of the rail 35 and are forced back into the support body 44 against the resilient forces from the springs 47.

Thus, when pushed down, the rail 35 is prevented from oscillating transversely by means of the pressure applied thereto through the guide pins 46.

Figure 5:
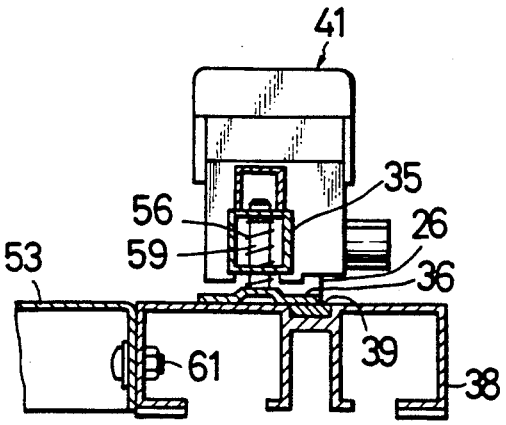
FIG. 5 is a sectional view taken along the line X—X of FIG. 2.

Referring back to FIG. 1, the reference numeral 36 denotes paper holder. The paper holder 36 is, as shown in FIGS. 3 and 5, attached to the reverse side of the rail 35 through pins 59 which extend through the rail 35. The paper holder 36 is constantly biased so as to project downward by means of resilient forces from springs 56 which are fitted thereon, respectively.

Figure 4:
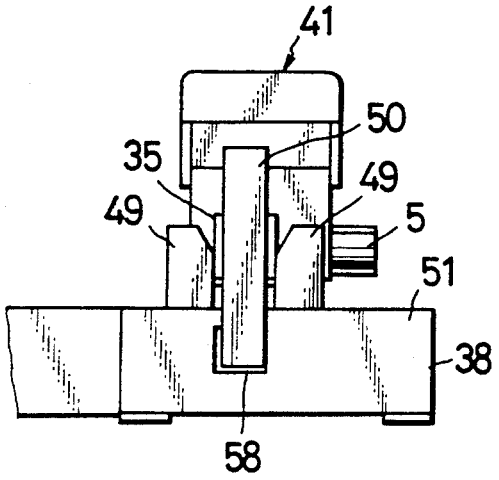
FIG. 4 is a front view of the arrangement shown in FIG. 2.

The reference numeral 49 in FIG. 1 denotes a guide member which is secured to the other end of the board 38. The guide member 49 has a recessed upper end which has a V-shaped cross-section, as shown in FIG. 4, the V-shaped recess being formed with predetermined dimensions so that the rail 35 is snugly fitted into the V-shaped recess without any looseness.

Figure 6:
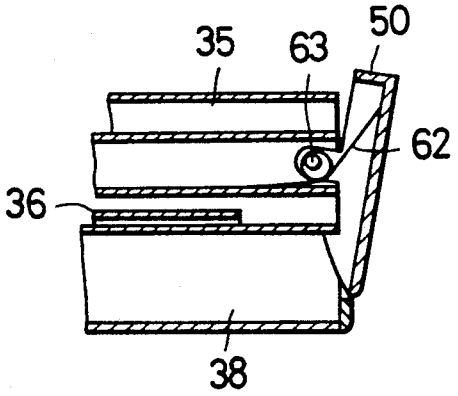
FIG. 6 is a vertical sectional view of the hook and members associated therewith, which are shown in FIG. 3.

The reference numeral 50 denotes a hook which is provided at the distal end of the rail 35. The hook 50 is attached to the rail 35 through a pin 63, as shown in FIG. 6. The hook 50 is subjected to resilient force from a spring 62 so that the hook 50 is engaged with the upper surface of the board 38. As shown in FIG. 4, a cover plate 51 is provided with a bore 58 for receiving the hook 50.

Referring back to FIG. 1, an abutment plate 54 is attached to a table 53, and ruled lines 55 are drawn perpendicular to the abutment plate 54 such that the ruled lines 55 are conformable with various sizes of paper. The ruled lines 55 extend parallel with the rail 35 when fixed at both ends thereof by the rail support 41 and the guide member 49.

The reference numeral 39 denotes a cutter mat. As shown in FIG. 5, the table 53 is secured to the board 38 by means of bolts 61, while the cutter mat 39 is replaceably fitted into a recess formed in the board 38.

The reference numeral 26 shown in FIG. 5 denotes a cutter blade which is provided along the edge of the paper holder 36. The cutting edge of the cutter blade 26 is disposed on the cutter mat 39.

In FIG. 1, the reference numeral 40 denotes a slider which is fitted on the rail 35. The slider 40 will next be explained in detail.

Figure 7:
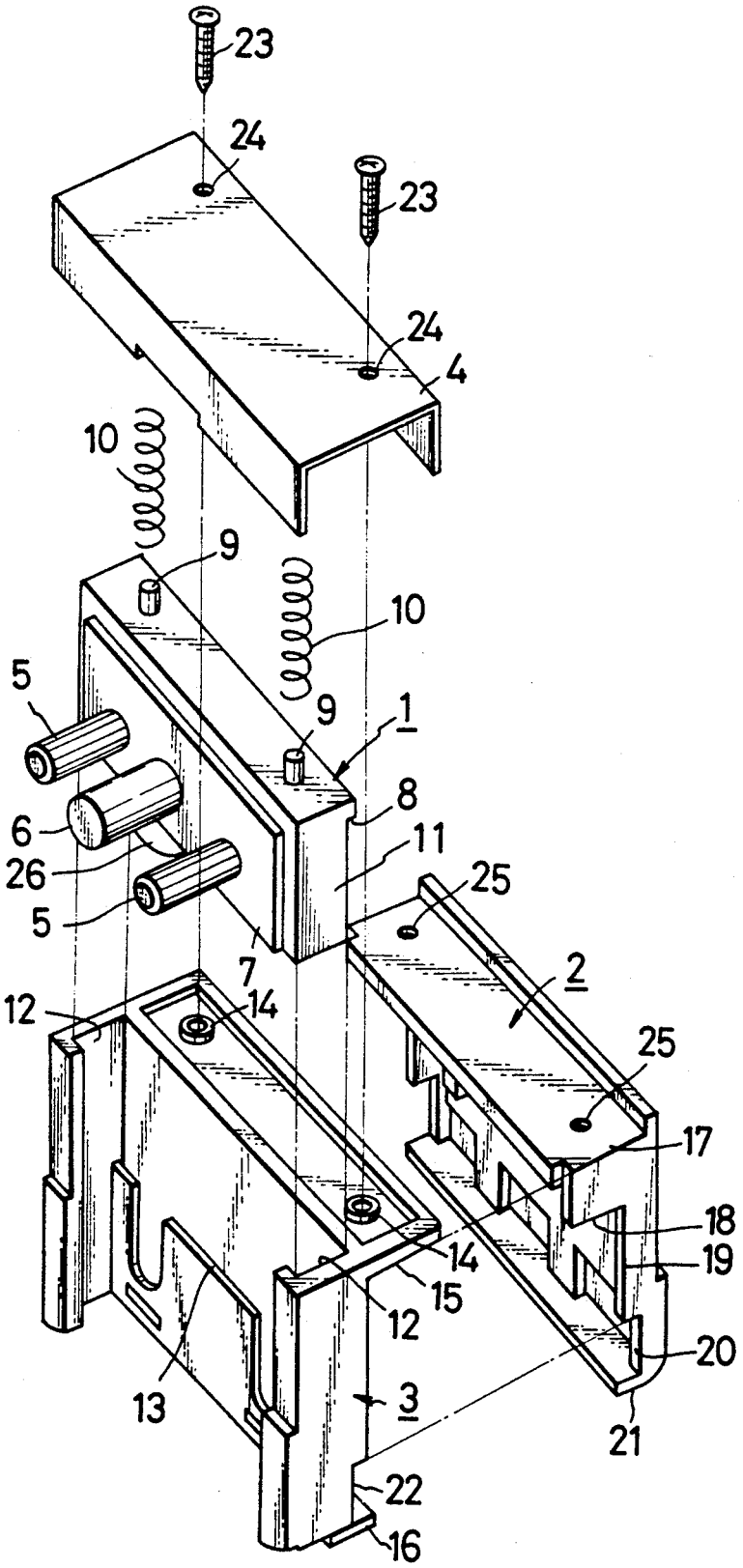
FIG. 7 is an exploded perspective view of the slider shown in FIG. 1.

Referring to FIG. 7, the reference numeral 1 denotes a cutter blade holder, 2 a slider body, 3 a cutter blade-side slider body, and 4 a cap.

The slider body 2 has a top guide portion 18 which is fitted on the rail 35, an upper guide side surface 19 and a lower guide 20. The reference numeral 21 denotes a paper pressing portion 21 which is formed at the lower end of the slider body 2.

The cutter blade-side slider body 3 has vertical slide grooves 12 respectively formed in two opposing side walls thereof. Slide portions 11 of the cutter blade holder 1 are fitted in the slide grooves 12, respectively. A stopper 8 which is formed on the cutter blade holder 1 is engaged with a stopper 13 provided on the cutter blade-side slider body 3. The reference numeral 22 denotes a lower guide, and 16 a paper pressing portion.

Figure 8:
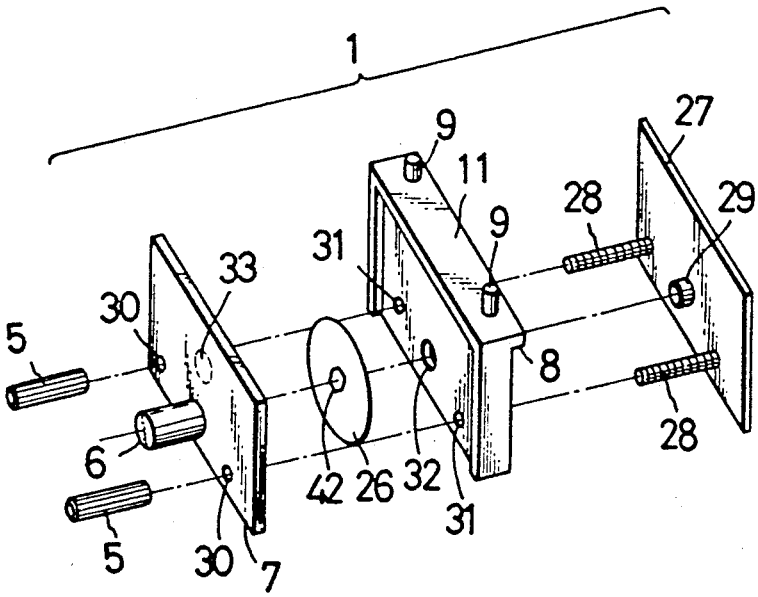
FIG. 8 is an exploded perspective view of the cutter blade holder shown in FIG. 7.
Figure 9:
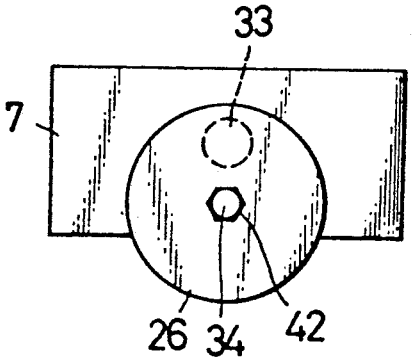
FIG. 9 is a front view of the cutter blade which is attached to the holding plate of the cutter blade holder shown in FIG. 8.

The cutter blade holder 1 is mainly comprised of a cutter blade holding plate 7, a slide portion 11 and a fastening plate 27, as shown in FIG. 8. The circular cutter blade 26 has a hexagonal bore 42 provided in the center, as shown in FIG. 9. The cutter blade mounting surface of the holding plate 7 is provided with a hexagonal column 34 which is rotatably supported in a bore provided in the center of a grip portion 6 and which has a hexagonal distal end. A magnet 33 is buried in the mounting surface of the holding plate 7 near the hexagonal column 34.

The cutter blade holder 1 is assembled as follows. As shown in FIGS. 8 and 9, the cutter blade 26 is first attached to the holding plate 7 by fitting the hexagonal column 34 provided on the holding plate 7 into the hexagonal bore 42 provided in the cutter blade 26. In consequence, the cutter blade 26 is magnetically held by the magnet 33 and thereby prevented from falling. Thus, the cutter blade 26 is readily attached to the holding plate 7. Next, the distal end of the hexagonal column 34 is inserted into a bore 32 provided in the slide portion 11, thereby fitting the holding plate 7, together with the cutter blade 26, to the slide portion 11. Then, slider fastening bolts 28 which are provided integral with the fastening plate 27 are inserted through through-bores 30 and 31 and fastened by means of nuts 5. At this time, the distal end of the hexagonal column 34 is passed through the bore 32 in the slide portion 11 and fitted to a boss 29.

The cutter blade holder 1 thus assembled is fitted into the slide grooves 12 in the cutter blade-side slider body 3, as shown in FIG. 7.

In the embodiment arranged as described above, the slider 40 is assembled to the rail 35 in the manner described below.

The cutter blade-side slider body 3 having the cutter blade holder 1 fitted therein and the slider body 2 are joined together in such a manner as to sandwich the rail 35 from both sides thereof. As a result, the top surface 17 of the slider body 2 is fitted to the ceiling 15 of the cutter blade-side slider body 3. After springs 10 have been fitted on respective spring retainers 9, the cap 4 is fitted onto the slider bodies 2 and 3 which are fitted to each other from the upper side thereof while compressing the springs 10, and screws 23 are passed through through-bores 24 and 14 and screwed into respective threaded bores 25.

In consequence, the springs 10 are compressed between the cap 4 and the cutter holder 1 which is retained by engagement between the stoppers 8 and 13, thus biasing the cutter blade holder 1 downward. The level of resilient force from the springs 10 is adjusted by appropriately fastening the screws 23. Even when the screws 23 are untightened, the resilient force from the springs 10 acts so as to press the ceiling 15 of the cutter blade-side slider body 3 against the top surface 17 of the slider body 2 and the fitting engagement between the two slider bodies 2 and 3 is maintained by means of the cap 4; therefore, the slider body 2 and the cutter blade-side slider body 3 are maintained in their fastened state.

Figure 10:
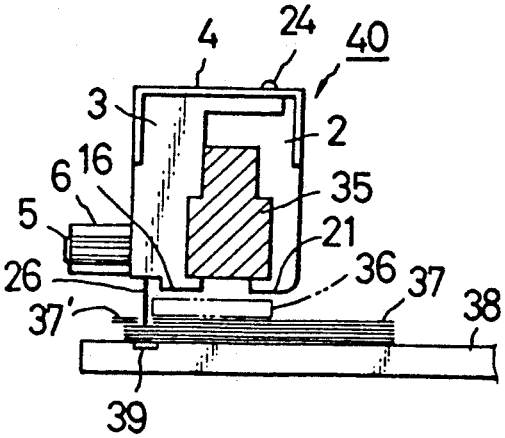
FIG. 10 is a front view of the cutter blade holder shown in FIG. 7 in its assembled state.

FIG. 10 shows the slider 40 assembled as described above.

When paper is to be cut, a stack of sheets of paper is first abutted against the abutment plate 54 shown in FIG. 1 to align the sheets of paper. Then, the sheets of paper are placed along a ruled line 55 corresponding to the size of the paper.

Then, the rail 35 is lowered. In consequence, the stack of sheets of paper is pressed by the paper holder 36. At this time, the rail 35 is guided by the guide pins 46 so that the rail 35 is prevented from oscillating transversely. There is therefore no fear of the sheets of paper held by the paper holder 36 being offset from each other.

The distal end of the rail 35 is fitted into the guide member 49. Thus, both ends of the rail 35 are fixedly positioned by the rail support 41 and the guide member 49. Then, the rail 35 is secured by means of the hook 50. As a result, the sheets of paper are reliably held. Since the rail 35 which is fixed at both ends thereof and the ruled lines 55 are parallel with each other, the abutment plate 54 and the rail 35 (the paper holder 36) are perpendicular to each other.

The following is a description of the method of cutting paper. As shown in FIG. 10, a stack of sheets of paper 37 is held on the board 38 by means of the paper holder 36. Then, the slider 40 is slid along the rail 35 while being pressed down.

Although the slider 40 is pressed against the sheets of paper 37, no excessive force is applied to the cutter blade 26 because it is subjected only to the resilient force from the springs 10 but no human power is directly applied thereto.

Thus, breakage of the cutter blade 26 is prevented.

When encountering a foreign matter such as a staple, the cutter blade 26 rides over such a foreign matter in such a manner as to move away from it upwardly since the cutter blade 26 is rotatable and the movable up and down through the springs 10. Therefore, the cutter blade 26 is prevented from being nicked.

Further, the cutter blade 26 is stopped from rotating relative to the hexagonal column 34 through the fitting engagement between the column 34 and the hexagonal bore 42.

To replace the cutter blade 26, the nuts 5 are removed and the holding plate 7 is removed by gripping the grip 6. Then, the cutter blade 26 is replaced with a new one.

The reason why the nuts 5 and the grip 6 project long is to prevent the user's hand from touching the cutter blade 26 during a cutting operation. Thus, safety is ensured.

In addition, the paper pressing portions 16 and 21 also function as means for limiting the cutting depth of the cutter blade 26, thus preventing breakage of the cutter blade 26.

Since the cutter blade 26 is vertically pressed against the stack of sheets of paper 37 so as to cut into the sheets and rotated in this state to cut them, there is no fear of the cut edges of the sheets being offset from each other.

What is claimed is:

1. A method of cutting paper comprising the steps of:

holding paper by means of a paper holder which is resiliently provided on a rail which is pivotally supported at one end thereof by a rail support provided on one end of a board so that an opposite end of said rail is movable up and down, subjecting two guide pins of said rail support to a biasing force using springs so as to resiliently support two side surfaces, respectively, of said rail when moved downward;

locating said paper holder between said rail and said board by mounting said paper holder on an underside of said rail;

securing said rail holding the paper by means of a hook provided at the opposite end of said rail; and cutting said paper with a cutter blade rotatably provided on a slider which is slidable along said rail and which is resiliently movable up and down by sliding said slider.

2. A paper-cutting machine comprising:

a board;

a rail support secured to one end of said board;

a rail pivotally supported at one end thereof by said rail support so that an opposite end thereof is movable up and down, wherein said rail has two side surfaces and said rail support has two guide pins which are subjected to a biasing force from respective springs so as to resiliently support both side surfaces, respectively, of said rail when moved downward;

a guide member secured to an opposite end of said board to that the opposite end of said rail is fitted to said guide member;

a paper holder provided between said rail and said board by mounting on an underside of said rail through a spring so that said paper holder is resiliently pressed against said board when said rail is moved downward;

a hook provided at the opposite end of said rail so that, when said rail is fitted to said guide member, said hook is engaged with said board to maintain said rail in the fitted state; and a resiliently movable, rotary cutter blade slidable along said rail to cut paper which is held by said paper holder, said rotary cutter blade being mounted rotatably on a cutter blade holder.

3. A paper-cutting machine according to claim 1, wherein said cutter blade holder is mounted on a slider, said slider being comprised of a cutter blade-side slider body, a slider body and said cutter blade holder which is attached to said cutter blade-side slider body, said cutter blade holder having a cutter blade holding plate, a slide portion, a fastening plate provided with a slider fastening screw, and a circular cutter blade rotatably mounted on said slide portion, said cutter blade holder being attached to said cutter blade-side slider body such that said cutter blade holder is vertically movable through resilient force from a spring.

* * * * *